US005148369A

United States Patent [19]

Uchinami et al.

[11] Patent Number: 5,148,369

[45] Date of Patent: Sep. 15, 1992

[54] AIR-FUEL CONTROL APPARATUS FOR AN INTERNAL COMBUSTION ENGINE

[75] Inventors: Masanobu Uchinami; Toshihisa Takahashi; Ryoji Nishiyama, all of Himeji; Hiroyoshi Suzuki, Amagasaki; Shinichi Nishida, Himeji, all of Japan

[73] Assignee: Mitsubishi Denki Kabushiki Kaisha, Tokyo, Japan

[21] Appl. No.: 693,066

[22] Filed: May 1, 1991

Related U.S. Application Data

[63] Continuation of Ser. No. 418,736, Oct. 3, 1989, abandoned, which is a continuation of Ser. No. 223,030, Jul. 22, 1988, abandoned.

[30] Foreign Application Priority Data

Aug. 8, 1987 [JP] Japan ..... 62-198559

[51] Int. Cl.[5] ..... F02D 41/14

[52] U.S. Cl. ..... 364/431.06; 364/431.05; 123/480; 123/672

[58] Field of Search ..... 364/431.06, 431.05, 364/431.07; 123/440, 480, 489, 492, 493

[56] References Cited

U.S. PATENT DOCUMENTS

| | | | |
|---|---|---|---|
| 4,321,903 | 3/1982 | Kondo et al. | 123/489 |
| 4,466,410 | 8/1984 | Sakaibara et al. | 123/489 |
| 4,513,713 | 4/1985 | Koumura et al. | 123/339 |
| 4,535,736 | 8/1985 | Taura et al. | 364/431.05 |
| 4,635,200 | 1/1987 | Egami et al. | 364/431.07 |
| 4,662,339 | 5/1987 | Hotate et al. | 123/486 |
| 4,733,358 | 3/1988 | Abthoff et al. | 123/489 |
| 4,759,329 | 7/1988 | Nubuo et al. | 123/478 |

FOREIGN PATENT DOCUMENTS 0136519 4/1985 European Pat. Off. .

*Primary Examiner*—Parshotam S. Lall
*Assistant Examiner*—V. N. Trans
*Attorney, Agent, or Firm*—Oblon, Spivak, McClelland, Maier & Neustadt

[57] ABSTRACT

An air-fuel ratio control apparatus for an internal combustion engine controls a fuel supplying means by a signal generated from an air-fuel sensor so that the air-fuel ratio of a gas mixture to be sucked into the internal combustion engine becoms a target air-fuel ratio. The air-fuel ratio control apparatus corrects the target air-fuel ratio by a parameter on the condition of the engine detected by the detecting means so that a fuel supplying device is controlled to obtain a corrected target air-fuel ratio.

11 Claims, 5 Drawing Sheets

AIR-FUEL CONTROL APPARATUS FOR AN INTERNAL COMBUSTION ENGINE

This application is a continuation of application Ser. No. 07/418,736, filed on Oct. 3, 1989, now abandoned, which is a continuation of application Ser. No. 07/223,030, filed on Jul. 22, 1988, now abandoned.

BACKGROUND OF THE INVENTION

1. Field of the Invention

The present invention relates to an air-fuel control apparatus for a fuel injection type internal combustion engine for an automobile.

2. Discussion of Background

It is necessary to maintain an air-fuel ratio for exhaust gas (hereinbelow, referred to simply as an air-fuel ratio) around a theoretical air-fuel ratio as possible in an internal combustion engine, particularly, one provided with a three-way catalytic exhaust gas purifying means. For this purpose, there has been practically used, for instance, an air-fuel ratio control apparatus which comprises an oxygen concentration sensor for detecting an air-fuel ratio on the basis of the concentration of oxygen contained in exhaust gas, an air-fuel ratio control means having an electronically-controlled fuel injection device for controlling the air-fuel ratio of a gas mixture to be supplied to the burning chamber of the engine by controlling the quantity of fuel to be injected, and an electronic control device for effecting feed-back control of a fuel injection quantity by the electronically controlled fuel injection device so that the value of the air-fuel ratio approaches the value of a theoretical air-fuel ratio in response to a calculated air-fuel ratio obtained by an output of oxygen concentration.

In the conventional air-fuel ratio control apparatus, the feed-back control was carried out so that the air-fuel ratio apporaches the theoretical air-fuel ratio, whereby exhaust gas purifying effect could be sufficiently improved by using the three catalytic system disposed in an exhaust gas discharging unit. However, although the conventional air-fuel ratio control apparatus could improve an exhaust gas purifying function, it is difficult to maintain a theoretical air-fuel ratio even under such condition that the engine is operated in a practically allowable state and the air-fuel ratio is at a lean side, and accordingly the performance of the engine can not sufficiently be obtained. Further, the feed-back control could not be obtained when a high torque is required by rendering the air-fuel ratio to be rich in a state of the full open of the engine. Accordingly, a precise correction of the air fuel ratio could not be obtained when an air-fuel ratio varies in a rich region because of variation with time and the scattering in dimensional value of the parts.

In particular, the above-mentioned problem becomes serious in an internal combustion engine with a supercharger. When a predetermined air-fuel ratio in the rich region is deviated toward further rich side, it falls in an inflamable range to thereby cause firing. On the contrary, when the predetermined air-fuel ratio is shifted into the lean side, the temperature of exhaust gas becomes high to thereby cause damage of the parts of the internal combustion engine.

In order to eliminate the above-mentioned problem, there has been a proposal such that an air-fuel ratio for an internal combustion engine is feed-back-controlled to give a predetermined air-fuel ratio by using a sensor which continuously measures an air-fuel ratio in a region covering the lean side and the rich side on the basis of specified components contained in exhaust gas (such sensor is referred to as an air-fuel ratio sensor hereinbelow).

As an example of the air-fuel ratio control in the conventional apparatus, a negative pressure in an intake air tube and the number of revolution of the engine are detected, and the fuel supplying device is controlled to obtain a target air-fuel ratio on the basis of the detected values of the pressure and the revolution number. In such control system, sufficient warming-up of the engine at the time immediately after starting the engine could not be obtained. Thus, the conventional air-fuel ratio control apparatus had such disadvantages that an effective feed-back control could not be obtained in a region that the engine does not operate stably if a relatively high torque is outputted by shifting an air-fuel ratio toward the rich side. Therefore, in the conventional apparatus, high, fine control of air-fuel ratio can not be obtained in the entire operable region of engine.

SUMMARY OF THE INVENTION

It is an object of the present invention to provide an air-fuel ratio control apparatus for an internal combustion engine capable of effecting a high, fine control of air-fuel ratio over the entire engine-operable region.

The foregoing and the other objects of the present invention have been attained by providing an air-fuel ratio control apparatus for an internal combustion engine for controlling a fuel supplying means by a signal generated from an air-fuel sensor which detects an air-fuel ratio on the basis of specific components contained in exhaust gas from the internal combustion engine so that the air-fuel ratio of a gas mixture to be sucked into the internal combustion engine becomes a target air-fuel ratio, the air-fuel ratio control apparatus characterized by comprising a detecting means for detecting a parameter concerning load on the engine, the number of revolution of the engine and a parameter concerning the condition of the engine, and a control means which calculates a target air-fuel ratio on the basis of the parameter concerning load on the engine and the number of revolution of the engine detected by the detecting means, and which corrects the target air-fuel ratio by the parameter on the condition of the engine detected by the detecting means so that a fuel supplying device is controlled to obtain a corrected target air-fuel ratio.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENT

Figure 1:
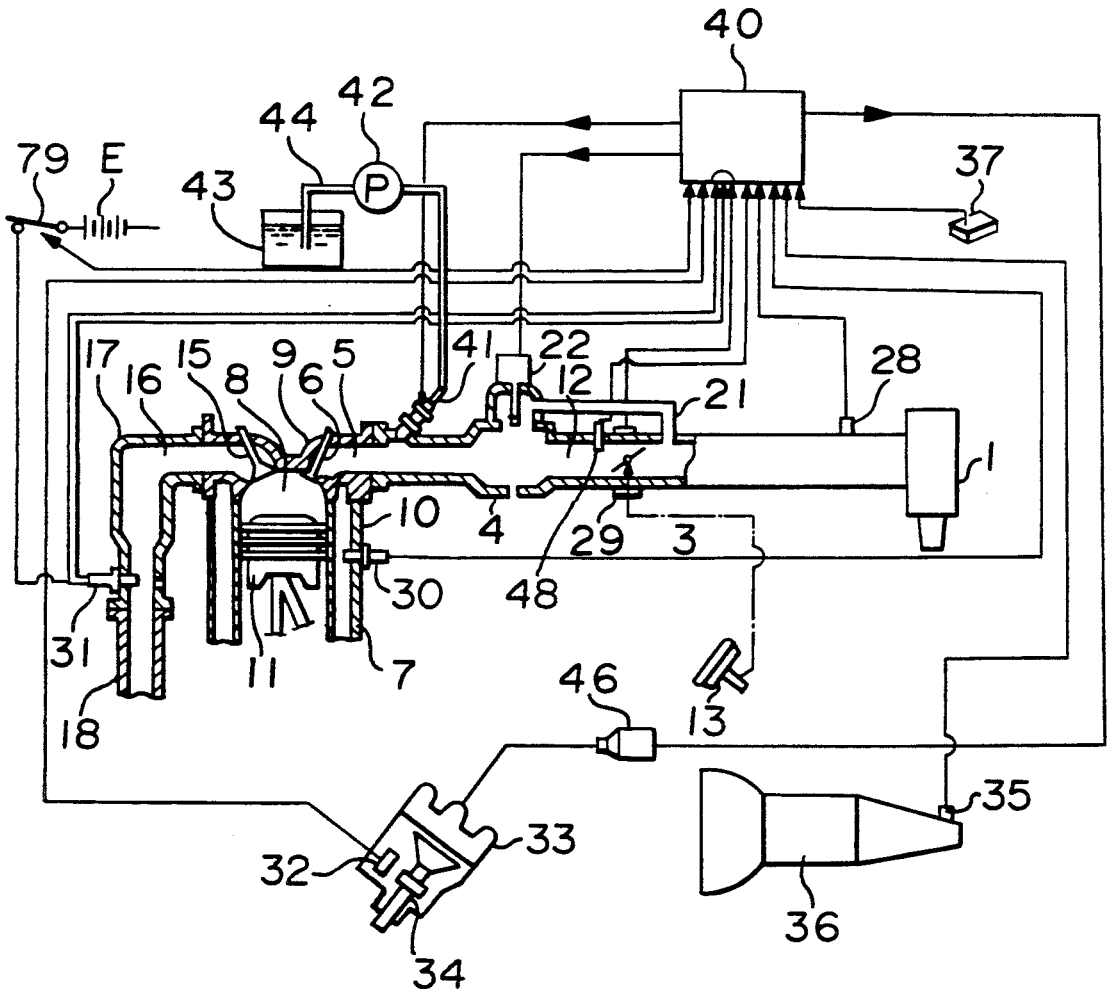
FIG. 1 is a diagram showing an electronic-controlled fuel-injection-type internal combustion engine for an automobile to which an embodiment of the air-fuel ratio control apparatus according to the present invention is applied.

Referring to the drawings, the same reference numerals designate the same or corresponding parts throughout the several views, and more particularly to FIG. 1, there is shown a systematic diagram of an electronic-controlled fuel-injection-type internal combustion engine for an automobile to which the present invention is applicable.

In FIG. 1, air sucked through an air cleaner 1 is supplied to a combustion chamber in the engine body 7 through an air intake passage 12 including a throttle valve 3, a surge tank 4, air intake port 5 and an intake valve 6.

A negative pressure sensor 48 is disposed in the air intake passage 12, and it is connected to an electronic control section 40.

A throttle valve 3 is operable in association with an acceleration pedal 13 in a drivers room. The combustion chamber 8 is defined by a cylinder head 9, a cylinder block and a piston 11. Exhaust gas produced by firing a gas mixture is discharged to the atmosphere through an exhaust valve 15, an exhaust port 16, an exhaust branch pipe 17 and an exhaust pipe 18.

A by-pass conduit 21 connects the upper stream side of the throttle valve 3 to the surge tank 4, and a by-pass flow control valve 22 controls a cross-sectional area in the by-pass conduit 21 to thereby maintain a constant revolution speed of engine at the idling time.

An intake air temperature sensor 28 is disposed in the air intake passage 12 to detect the temperature of intake air, and a throttle position sensor 29 detects the degree of opening of the throttle valve 3.

A water temperature sensor 30 is attached to the cylinder block 10 to detect the temperature of cooling water. An air-fuel ratio sensor 31 is attached to the collecting portion in the exhaust gas branch pipe 17 and is connected a battery E through a switch 79 so that an air-fuel ratio at the collecting portion is detected. A crank angle sensor 32 is adapted to detect a crank angle of a crank shaft and the number of revolution of the crank shaft on the basis of the revolution of the shaft 34 of a distributor 33 which is connected to the crank shaft (not shown) of the engine body 7.

A gear position sensor 35 on a speed change gear 36 detects a position of transmission, e.g. a neutral position or a driving position.

Outputs from the various detecting means such as the intake air temperature sensor 28, the throttle position sensor 29, the water temperature sensor 30, the air-fuel ratio sensor 31, the crank angle sensor 32 and the gear position sensor 35 and a voltage signal from the battery 37 are supplied to the electronic control section 40. Fuel injection valves 41 are respectively provided near the intake ports 5 in correspondence to the cylinders and a pump 42 supplys fuel from a fuel tank 43 to the fuel injection valves 41 through a fuel conduit 44.

The electronic control section 40 receives input signals as parameters from the various sensors to calculate a quantity of fuel to be injected from each of the fuel injection valves 41, and supplys pulse signals having a pulse width corresponding to the calculated quantity of fuel to be injected to the fuel injection valves 41. The fuel injection valves 41 are opened in response to the pulse width to inject fuel.

The electronic control section 40 controls the by-pass flow control valve 22 and ignition coils 46. The secondary side of each of the ignition coils 46 is connected to the distributor 33.

FIG. 1 shows a D-J type fuel injection system for an electronic-controlled fuel-injection-type internal combustion engine, in which a basic injection pulse time is calculated on the basis of the output values of at least one of the negative pressure sensor 48 and the engine revolution detecting sensor 32, the basic injection pulse time is subjected to correction by a signal from the intake air temperature sensor 28, correction by a transient phenomenon and correction by a feed-back signal from the air-fuel ratio sensor, whereby a fuel injection quantity to the fuel injection valves 41 is determined to be a target air-fuel ratio.

Figure 2:
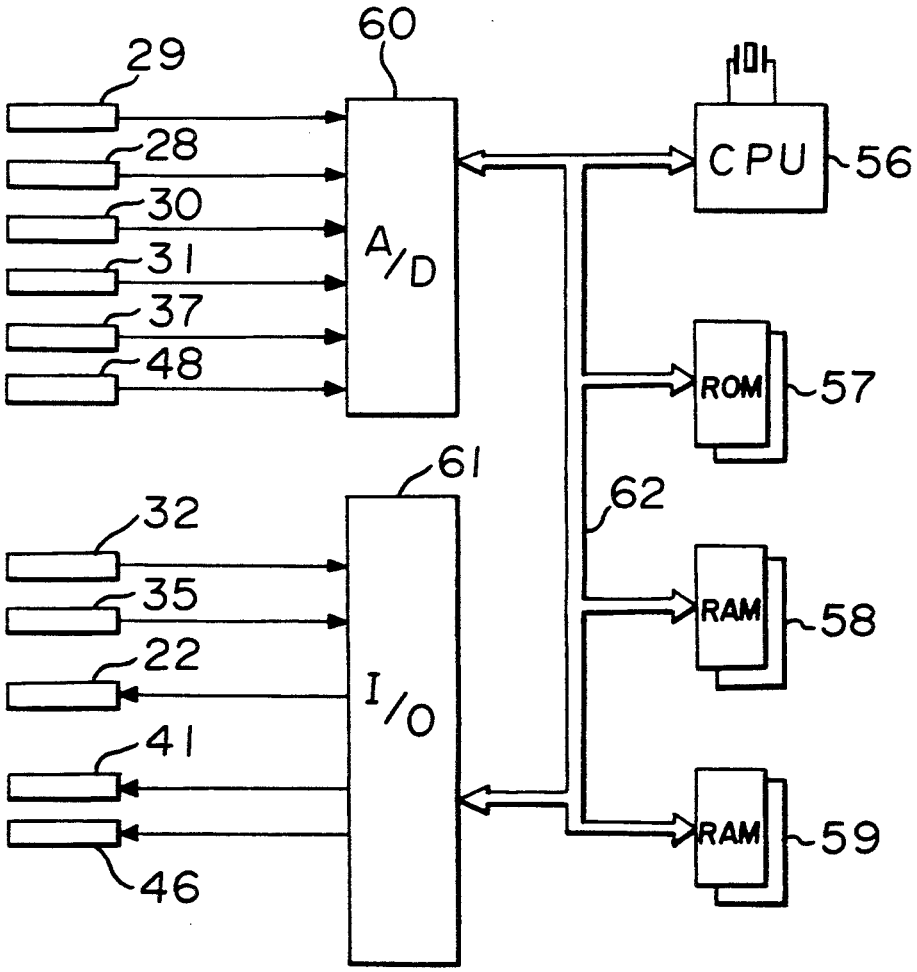
FIG. 2 is a block diagram showing an electronic control section in the electronic-controlled fuel-injection-type internal combustion engine in FIG. 1.

FIG. 2 is a block diagram showing the construction of the electronic control section 40 in more detail. The electronic control section 40 is constituted by a micro processor which comprises a central processing unit (CPU) 56 for effecting calculation and control, a read-only memory (ROM) 57 which stores a program for correction routine (described later) and a program for by-pass flow controlling routine, a random-access memory (RAM) 58 and a second RAM 59, both being involatile memory devices adapted to receive power from an auxiliary power source even at the time of stop of the engine and to store data essential to operate the electronic control section, an analogue/digital (A/D) transducer 60, an input/output (I/O) device 61 and a bus 62 connecting these elements.

The output of the throttle position sensor 29, the intake air temperature sensor 28, the water temperature sensor 30, the air-fuel ratio sensor 31, the battery 37, and the negative pressure sensor 48 are supplied to the A/D transducer 60.

The outputs of the crank angle sensor, the engine revolution sensor 32 and the gear position sensor 35 are supplied to the I/O device 61. On the other hand, the by-pass flow control valve 22, the fuel injection valves 41 and the ignition coils 46 receive an input signal from the CPU 56 through the I/O device 61.

In the following, a case that a target air-fuel ratio is calculated by the electronic control section 40 having the above-mentioned construction; the target air-fuel ratio is corrected in accordance with a given process so that a fuel supplying device is controlled in accordance with the corrected target air-fuel ratio, will be described. A program for the above-mentioned process is stored in the ROM 57.

Figure 3:
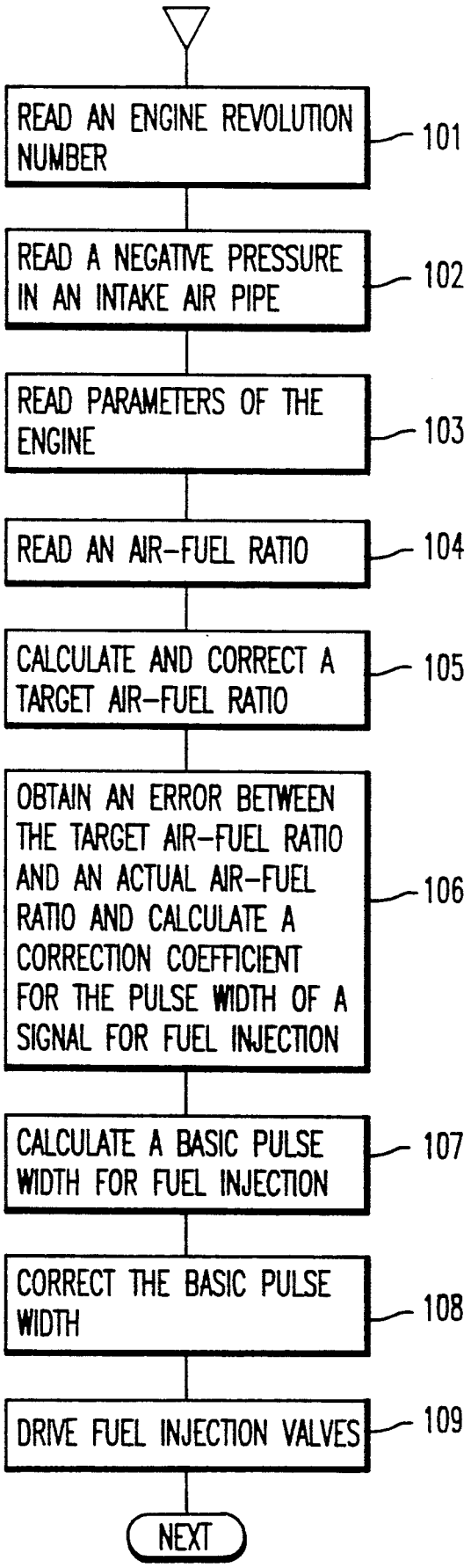
FIGS. 3 and 4 are respectively flow charts showing an embodiment of the operation for carring out an air-fuel ratio control by the electronic control section shown in FIG. 2.

FIG. 3 is a flow chart for effecting the above-mentioned process. Namely, the electronic control section 40 reads the revolution number of the engine (Step 101), a negative pressure in an intake air pipe as a parameter of load of the engine (Step 102), conditions of the engine, as state parameters of the engine, e.g. the condition of warming-up of the engine by receiving an signal from the water temperature sensor 30, the condition of acceleration or deceleration of the engine by a signal from the throttle position sensor 29 (Step 103), and the actual air-fuel ratio by an output from the air-fuel ratio sensor 31 (Step 104), respectively.

Then, the electronic control section 40 calculates a target air-fuel ratio on the basis of the received signals indicative of the revolution number of the engine, the negative pressure in the intake air pipe and the conditions of the engine (Step 105).

Figure 4:
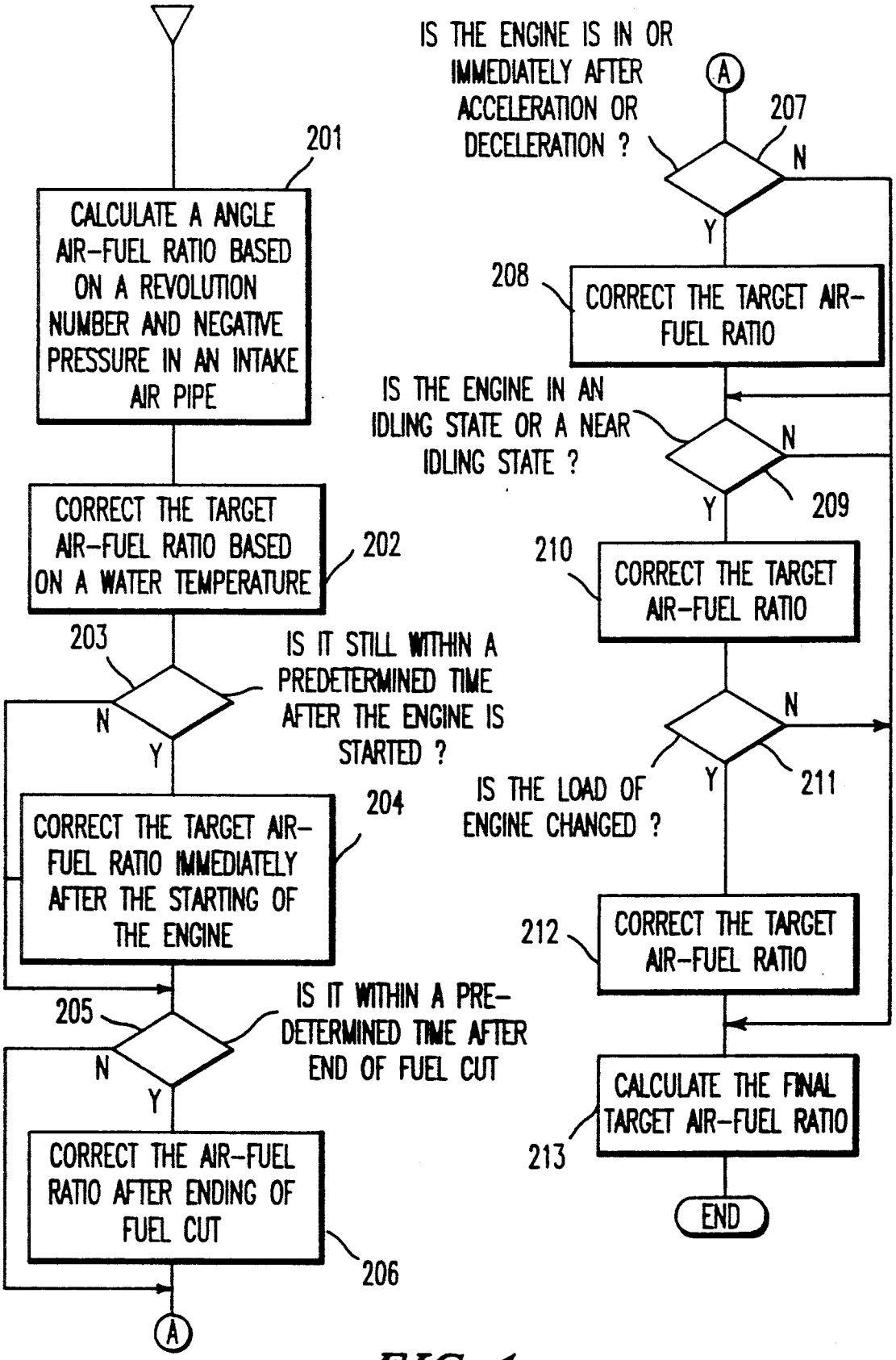

FIG. 4 shows the detail of calculation of the above-mentioned parameters.

Figure 5:
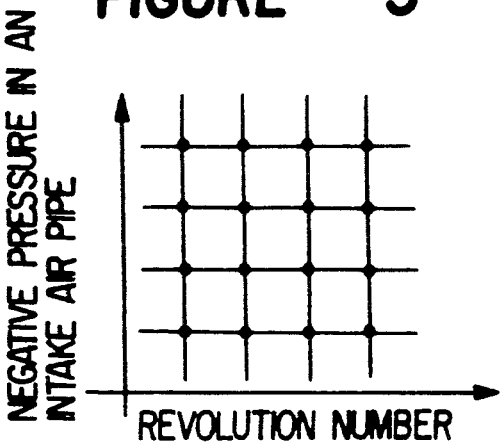
FIG. 5 is a graphical representation showing correction coefficients determined by the revolution of an engine and a negative pressure in the intake air pipe, which is used for calculating a target air-fuel ratio by the electronic control section.

In FIG. 4, a basic target air-fuel ratio is calculated on the basis of the revolution number on the engine and the negative pressure in the intake air pipe (Step 201). In this case, a map of the revolution number vs. the negative pressure in the intake air pipe as shown in FIG. 5 is used, whereby a point is selected by the revolution number and the negative pressure.

Figure 6:
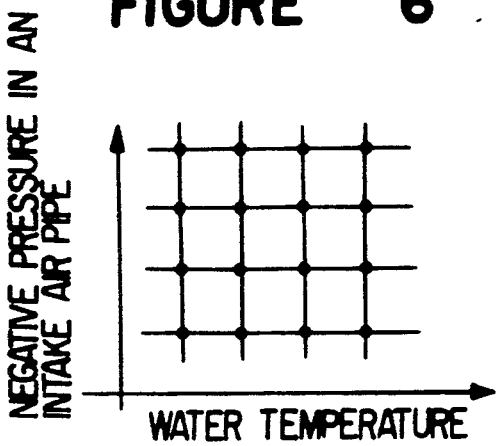
FIG. 6 is a graphical representation showing correction coefficients determined by a water temperature in the engine and a negative pressure in the intake air pipe which is used for calculating the air-fuel ratio.

Then, the basic target air-fuel ratio is corrected on the basis of a signal from the water temperature sensor 30 (Step 202). In this case, a map showing a relation of the negative pressure in the intake air pipe to the water temperature as shown in FIG. 6 is used to determine a correction coefficient. Generally, the map is so determined that the target air-fuel ratio is adjusted to be rich when the water temperature is low.

Figure 7:
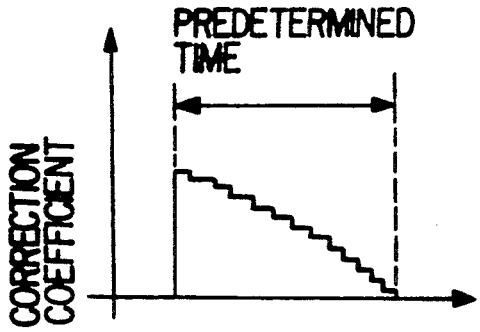
FIGS. 7 and 8 are respectively diagrams showing relations of time vs. correction coefficient at the time of changing the neutral position to the driving position of the speed change gear in order to calculate the target air-fuel ratio.

At Step 203, determination is made as to whether or not it is still within a predetermined time (e.g. 5 seconds) after the engine is started and reaches a number of revolution of 500 rpm. When it is within the predetermined time, correction of the air-fuel ratio is so made that the air-fuel ratio is gradually changed from the rich side to the lean side by correction coefficients which gradually decreases depending on a laps of time as shown in FIG. 7 (Step 204). The predetermined time is made variable by a signal from the water temperature sensor 30; namely, the lower the water temperature is, the longer the time is, and the degree of change in the rich side is made greater.

When the predetermined time is already passed after starting of the engine at Step 203, the operation of Step 205 is taken. At Step 205, determination is made as to whether or not it is within a predetermined time after returning from the condition that fuel is cut. When it is within the predetermined time, the operation of Step 206 is taken. On the other hand, the predetermined time has already passed, then, the operation of Step 207 is taken.

Figure 8:
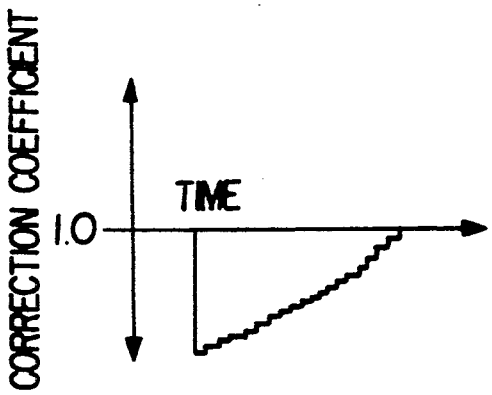

At Step 206, correction of the air-fuel ratio is made so that it is gradually changed from the lean side to the rich side by the correction coefficients which gradually decreases as time passes as shown in FIG. 8, whereby occurrence of sudden change in the air-fuel ratio to thereby causing sudden change in torque in the engine is avoided.

At Step 207, determination is made as to whether or not the engine is in a state of acceleration or deceleration, by utilizing the deviation in time of the output signal of the throttle position sensor 29, or whether or not it is still within a predetermined time after the acceleration or deceleration is stopped. When the above-mentioned condition is established, the air-fuel ratio is changed from the rich side to the lean side, or from the lean side to the rich side smoothly by the correction coefficients which change as time passes as shown in FIGS. 7 or 8 at Step 208, whereby a sudden change of torque in the engine is prevented. When the above-mentioned condition is not established, the operation of Step 209 is taken.

Figure 9:
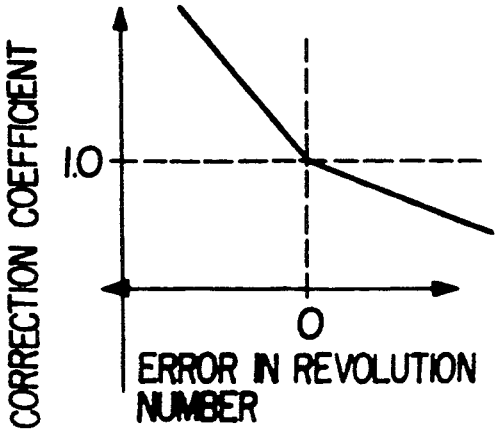
FIG. 9 is a diagram showing a relation of a deviation in engine revolution to a correction coefficient for calculating the target air-fuel ratio.

At Step 209, determination is made on the basis of the output signal of the throttle position sensor 29 and the revolution number of the engine as to whether the number of revolution of the engine shows an idling state in which the throttle valve is almost closed and the number of revolution is sufficiently low, or a state near the idling operation. When the above-mentioned condition is established at Step 209, correction of the air-fuel ratio is made by using the correction coefficients as in FIG. 9 so as to correspond the deviation of the engine revolution number at Step 210, and at the same time, correction of the target value is made in such a manner that when the revolution number is decreased, the air-fuel ratio is rendered to be rich, and when the revolution number is increased, the air-fuel ratio is rendered to be lean, whereby the fluctuation of the revolution number is controlled.

At Step 211, determination is made on the basis of the signal of the gear position sensor 35 as to whether or not the speed change gear 36 is just shifted from the neutral position to the driving position. When the above-mentioned condition is established, the target air-fuel ratio appearing immediately after change in a load is temporarily set at the rich side by the correction coefficients which gradually decrease as time passes as in FIG. 7, whereby sudden reduction of the number of revolution is prevented.

When the above-mentioned condition is not established, the final target air-fuel ratio previously calculated is stored in the RAM 58 at Step 213, whereby Step 105 for calculating the target air-fuel ratio is ended.

Returning to the operations as shown in FIG. 3, the deviation between the calculated target air-fuel ratio and the actual air-fuel ratio is processed at Step 106. When the target air-fuel ratio > the actual air-fuel ratio is established, a correction coefficient which makes the pulse width for supplying fuel large is determined. On the other hand, when the target air-fuel ratio < the actual air-fuel ratio, a correction coefficient which makes the pulse width small is determined.

At Step 107, a basic pulse width for supplying fuel is determined on the basis of the revolution number of the engine and the negative pressure in the intake air pipe. At Step 108, the basic pulse width is corrected by the correction coefficient by the deviation of the air-fuel ratio and a correction coefficient on the basis of the output signal of the intake air temperature sensor 28. At Step 109, the fuel injection valves 41 is actuated with supply of an amount of fuel which is determined by the pulse width after correction.

In the above-mentioned embodiment, the negative pressure in the intake air pipe is used as a parameter indicating a load on the engine. However, the same effect is obtained by using an amount of intake air per unit revolution number (Q/N) in an L-J type fuel injection system in which an amount of air sucked is directly measured, instead of using the signal of the throttle position sensor or the negative pressure in the intake air pipe.

In the above-mentioned embodiment, tee predetermined time passing after returning from the condition of cutting fuel is used as a parameter indicating the condition of the engine, or the correction coefficient is used as a time parameter. However, the number of ignition may be used as a parameter instead of the time parameter.

Thus, in accordance with the present invention the engine can be operated in a stable manner even when warming-up of the engine is insufficient and the engine is in the unstable condition, whereby highly precise control of air-fuel ratio is obtainable.

Obviously, numerous modifications and variations of the present invention are possible in light of the above teachings. It is therefore to be understood that within the scope of the appended claims, the invention may be practiced otherwise than as specifically described herein.

What is claimed is:

1. An air-fuel ratio control apparatus for controlling a fuel supply means in a fuel-injected internal combustion engine comprising:

an exhaust gas sensor for detecting the actual air-fuel ratio and for outputting a signal indicative of said actual air-fuel ratio;

means for detecting the actual load on said engine;

means for detecting the RPM of said engine;

a memory storing data of basic target air-fuel ratio in which the load and the RPM are used as parameters;

means for reading the basic target air-fuel ratio from the memory to obtain a corrected target air-fuel ratio by calculation, means for producing a feedback control signal based upon the difference between the target air-fuel ratio and the actual air-fuel ratio based upon said signal produced from said exhaust gas sensor, and means for producing a signal for adjusting said injection system so as to alter the air-fuel ratio in a series of gradual step like changes depending on the lapse of time and the difference between said detected ratio and said optimum ratio.

2. An apparatus as in claim 1, wherein said load on said engine is detected by the degree of the opening of a throttle.

3. An apparatus as in claim 1, wherein said load on said engine is detected by a measured intake-air quantity per RPM.

4. An apparatus as in claim 1, wherein said load on said engine is detected by the pressure in said intake air manifold.

5. An apparatus as in claim 4 wherein said means for determining means further comprises:

means to factor a condition of said engine.

6. An apparatus as in claim 5 wherein said means to factor comprises:

a water temperature detection means.

7. An apparatus as in claim 5 wherein said means to factor comprises:

means for calculating, determining how long said engine has been running.

8. An apparatus as in claim 5 wherein said means to factor comprises:

means for determining the time period after a fuel cut has returned.

9. An apparatus as in claim 5 wherein said means to factor comprises:

means for determining the number of revolutions after a fuel cut has returned.

10. An apparatus as in claim 5 wherein said means to factor comprises:

means for determining the time period since a change in acceleration of said engine.

11. An apparatus as in claim 5 wherein said means to factor comprises:

means for determining the number of revolutions in an idle or near idle condition of said engine.

* * * * *